US011255504B2

(12) United States Patent
Gromfeld

(10) Patent No.: US 11,255,504 B2
(45) Date of Patent: Feb. 22, 2022

(54) SINGLE-PIECE OPTICAL PART MADE OF TRANSPARENT OR TRANSLUCENT MATERIAL COMPRISING AN INACTIVE SURFACE WITH A SCATTERING SEGMENT

(71) Applicant: Valeo Vision, Bobigny (FR)

(72) Inventor: Yves Gromfeld, Angers (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 16/575,669

(22) Filed: Sep. 19, 2019

(65) Prior Publication Data

US 2020/0103087 A1 Apr. 2, 2020

(30) Foreign Application Priority Data

Sep. 28, 2018 (FR) ..... 18 58944

(51) Int. Cl.

| | |
|---|---|
| ***F21S 41/20*** | (2018.01) |
| ***F21S 41/365*** | (2018.01) |
| ***F21S 41/32*** | (2018.01) |
| ***F21V 5/00*** | (2018.01) |
| *F21S 41/275* | (2018.01) |

(52) U.S. Cl.

CPC ..... *F21S 41/285* (2018.01); *F21S 41/322* (2018.01); *F21S 41/365* (2018.01); *F21V 5/008* (2013.01); *F21S 41/275* (2018.01)

(58) Field of Classification Search

CPC ..... F21S 41/285; F21S 41/322; F21S 41/365; F21S 41/147; F21S 41/148; F21S 41/151; F21S 41/27; F21S 41/275; F21V 5/008

See application file for complete search history.

(56) References Cited

U.S. PATENT DOCUMENTS

| | | | | |
|---|---|---|---|---|
| 3,020,396 | A * | 2/1962 | Worboys | F21L 15/02 362/331 |
| 2007/0230204 | A1* | 10/2007 | Tatsukawa | F21S 41/143 362/539 |
| 2008/0165548 | A1* | 7/2008 | Misawa | B60Q 1/2607 362/487 |
| 2008/0170409 | A1* | 7/2008 | Tendo | F21S 41/275 362/538 |
| 2012/0069576 | A1 | 3/2012 | Chang | |

(Continued)

FOREIGN PATENT DOCUMENTS

| | | |
|---|---|---|
| DE | 10 2008 003 929 A1 | 7/2008 |
| DE | 10 2013 002 965 A1 | 8/2014 |

(Continued)

OTHER PUBLICATIONS

Preliminary French Search report dated Jun. 18, 2019 in French Application 18 58944 filed on Sep. 28, 2018 (with English Translation of Categories of Cited Documents).

*Primary Examiner* — Zheng Song

(74) *Attorney, Agent, or Firm* — Oblon, McClelland, Maier & Neustadt, L.L.P.

(57) ABSTRACT

A single-piece optical part made of transparent or translucent material, comprising a plurality of active surfaces arranged to form a beam, including an entrance dioptric interface and an exit dioptric interface, inactive surfaces joining the active surfaces, at least one of the inactive surfaces comprising a scattering segment so as to scatter the rays that reach it.

23 Claims, 5 Drawing Sheets

(56) References Cited

U.S. PATENT DOCUMENTS

| | | | | |
|---|---|---|---|---|
| 2014/0036526 | A1* | 2/2014 | Sato | F21S 43/14 362/518 |
| 2014/0146555 | A1* | 5/2014 | Choi | F21S 41/275 362/512 |
| 2015/0241616 | A1* | 8/2015 | Bungenstock | F21S 43/26 362/511 |
| 2015/0267895 | A1* | 9/2015 | Kono | G02B 19/0028 362/300 |
| 2016/0238207 | A1* | 8/2016 | Hsieh | F21S 41/275 |
| 2017/0010403 | A1* | 1/2017 | Sato | G02B 6/0038 |
| 2017/0130923 | A1* | 5/2017 | Nishimura | F21S 41/43 |
| 2017/0299137 | A1* | 10/2017 | Kinoshita | F21S 41/43 |
| 2018/0038569 | A1* | 2/2018 | Hanulak | F21S 43/245 |
| 2018/0149335 | A1* | 5/2018 | Paroni | G02B 27/0961 |
| 2018/0340666 | A1* | 11/2018 | Song | F21S 41/275 |
| 2018/0370441 | A1* | 12/2018 | Lisowski | B60R 1/04 |
| 2019/0196090 | A1* | 6/2019 | Mori | F21S 41/00 |
| 2019/0234585 | A1* | 8/2019 | Le Corre | F21S 41/285 |
| 2019/0242543 | A1* | 8/2019 | Guan | F21S 41/147 |
| 2019/0353320 | A1* | 11/2019 | Shikata | F21S 41/26 |

FOREIGN PATENT DOCUMENTS

| | | | | |
|---|---|---|---|---|
| DE | 20 2018 002 427 U1 | | 7/2018 | |
| JP | 2014-063604 A | | 4/2014 | |
| WO | WO 2017/120630 | * | 7/2017 | F21S 8/10 |

* cited by examiner

SINGLE-PIECE OPTICAL PART MADE OF TRANSPARENT OR TRANSLUCENT MATERIAL COMPRISING AN INACTIVE SURFACE WITH A SCATTERING SEGMENT

The present invention relates to the field of luminous devices, in particular luminous motor-vehicle devices, in which a single-piece optical part made of transparent or translucent material is used to guide light and/or form the corresponding light beam.

To this end, such an optical part comprises active surfaces that are specifically arranged so as to guide and deviate the light rays, in particular by total internal reflection or by refraction. An example of such an optical part is described in document FR3039883A1.

Nevertheless, it is possible to observe that with certain of these optical parts certain rays, called parasitic rays, are sent in the beam in undesirable directions. This may result in regions of extra brightness or luminous nonuniformities in the beam emitted by the luminous device. This may be detrimental to comfort and safety, in particular in the case of low beams.

A low beam emits a beam for lighting the road that comprises a cutoff above which almost no ray is sent, making it possible to avoid subjecting followed or oncoming vehicles to glare. It is therefore all the more important in this case to avoid parasitic rays that would end up above the cutoff and run the risk of subjecting the drivers of these vehicles to glare.

One technical problem that the present invention aims to solve is therefore that of avoiding the formation of parasitic rays in the light beam produced by a luminous device by means of an optical part made of transparent material.

To this end, a first subject of the invention is a single-piece optical part made of transparent or translucent material, comprising:

- a plurality of active surfaces arranged to form a beam, including an entrance dioptric interface and an exit dioptric interface, and
- inactive surfaces joining the active surfaces;

at least one of the inactive surfaces comprises a scattering segment so as to scatter the rays that reach it.

Specifically, the applicant has noted that certain of the parasitic rays formed into the light beams produced using transparent or translucent single-piece optical parts were in fact reflected by optically inactive surfaces of these optical parts before exiting therefrom. This is due to the fact that certain of the light rays initially emitted, by the light source of the optical module containing such an optical part, do not reach as desired the optically active surfaces, i.e. the active surfaces arranged to form the beam, but reach optically inactive surfaces. These optically inactive surfaces are said to be inactive because they should not receive these rays, or at least should receive only a small amount of these rays, and are not designed to deviate these rays so as to form the beam.

By virtue of the invention, these parasitic rays are removed and/or the effect of these parasitic rays is decreased, for example by spreading them forward. In this way, undesirable luminous concentrations in the beam are decreased.

The optical part according to the invention may optionally have one or more of the following features:

- the scattering segment is covered with a plurality of structures arranged so as to scatter the rays reaching the corresponding scattering segment; the scattering means may thus be produced directly during the manufacture of the optical part;

- the scattering segment is corrugated; this makes it possible to more easily compute this surface segment;
- the scattering segment comprises striations that are parallel to one another;
- the optical part is obtained by moulding, the striations being parallel to the demoulding direction; this allows the striations to be produced by moulding with a simple demoulding step;
- the plurality of structures is formed by a periodic variation in the corresponding inactive surface; this allows this surface segment to be more easily computed;
- the periodic variation in the scattering segment of the inactive surface or in at least one of the inactive surfaces is arranged solely in two variation directions that are transverse to each other; this is an example of production of embossments;
- the optical part is obtained by moulding, the two variation directions being orthogonal to the demoulding direction; this allows these variations to be produced by moulding with a simple demoulding step;
- the periodic variations are defined by at least one sinusoidal function; particularly effective results are obtained with this type of function;
- one of the active surfaces is a deflector arranged so as to receive light rays coming from the entrance dioptric interface and to steer them downstream, in particular towards the exit dioptric interface; this allows a cutoff-containing beam to be produced with few parasitic rays above the cutoff.

Another subject of the invention is a luminous vehicle device, in particular a headlamp, comprising an optical part according to the invention and at least one light source that emits its rays essentially towards said entrance dioptric interface.

The light source may be a light-emitting diode (LED).

Another subject of the invention is a vehicle comprising a vehicle lighting and/or signalling device according to the invention, in particular connected to the electrical supply of the vehicle.

Unless otherwise indicated, the terms “front”, “rear”, “top”, “bottom”, “transverse”, “longitudinal” and “horizontal” refer to the direction of emission of light out of the corresponding luminous module. Unless otherwise indicated, the terms “upstream” and “downstream” refer to the direction of propagation of the light.

Other features and advantages of the invention will become apparent on reading the detailed description of the following nonlimiting examples, for the comprehension of which description the reader is referred to the appended drawings, in which:

FIGS. 1 to 3 illustrate an optical part 1 according to a first example embodiment of the invention. It is here a question of a single-piece optical part 1 made of transparent or translucent material and in particular of polycarbonate (PC).

Figure 1:
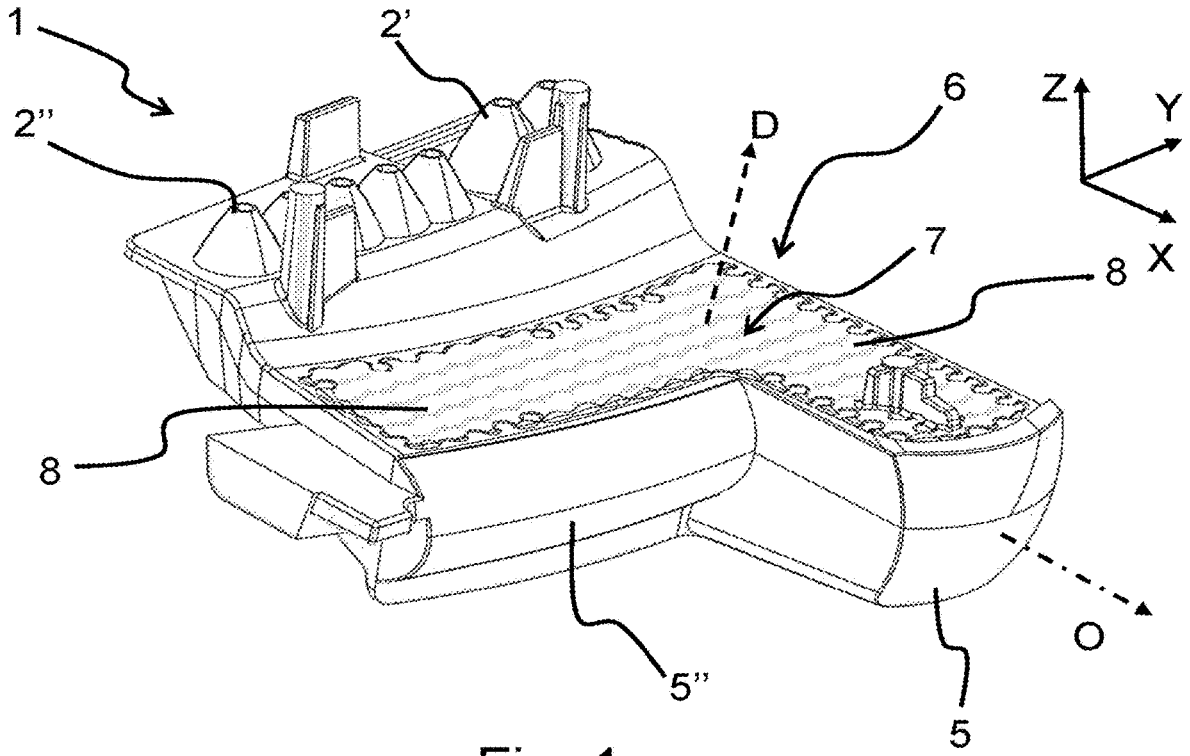
FIG. 1 is a perspective view from in front and above of an optical part according to a first example of the invention.

In this example, it is a question of an optical part of a luminous vehicle headlamp module.

The optical part 1 comprises a first plurality of collimators 2' and a second plurality of collimators 2". Each of these collimators 2', 2" comprises an entrance dioptric interface 2 intended to receive the light rays r1, r2, r3 emitted by a light source 21 that here is intended to be placed facing and close to the free end of the corresponding collimator 2', 2", thereabove so as to emit light downwards in this example.

In this example, the light source is a light-emitting diode 21 or LED.

These light rays r1, r2, r3 enter by refraction into the collimators 2', 2", and therefore into the optical part 1.

The first plurality of collimators here comprises two collimators 2', that are each optically coupled to a reflecting unit 3, that is for its part optically coupled to a unit 4 for generating a cutoff, which for its part is coupled to an exit unit 5. These various elements are therefore coupled to one another and arranged so as to form the light rays emitted by the light sources 21 so as to form a cutoff-containing beam.

Each collimator 2' is arranged to send, here by refraction and total internal reflection, the light rays r1, r2, r3 emitted by the LED 21, in a further concentrated beam, in the direction of the reflecting unit 3.

This reflecting unit 3 is here a dioptric interface arranged so as to reflect, by total internal reflection, these rays r1, r2, r3 towards the cutoff-generating unit 4, and more particularly towards the ridge 4*a* of this cutoff-generating unit 4. For example, the reflecting unit 4 may reflect these rays r1, r2, r3 towards a focal zone arranged on this ridge 4*a*.

These rays r1, r2, r3 pass this ridge 4*a* in three different ways, as will be explained below, then reach the exit unit 5, here the exit dioptric interface 5 of the optical part 1. They then exit from the optical part 1 by refraction through the exit dioptric interface 5.

This exit dioptric interface 5 is arranged so as to form a unit for projecting the image of the ridge 4*a*.

Thus, the rays r1 that pass the closest to the ridge 4*a*, without encountering the surface of the deflector, in particular in a focal zone of the exit dioptric interface 5, are refracted by the exit dioptric interface 5 parallel to an optical axis O of the luminous module.

In contrast, the rays r2 and r3 that pass above this ridge 4*a* are refracted downwards by the exit dioptric interface 5.

Certain of these downwards-refracted rays r2 are first directly reflected by the reflecting unit 3 onto the exit dioptric interface 5, these rays passing above the ridge 4*a*. Other downwards-refracted rays r3 are first reflected by the reflecting member 3 behind the ridge 4*a*, and are therefore reflected by the deflector 4, by total internal reflection, towards the exit dioptric interface 5, these rays also passing above the ridge 4*a*.

Most, or even all, of the rays r1, r2, r3 therefore participate in the formation of the beam that exits from the optical part 1. This beam is the light beam emitted by the optical module.

Figure 6:
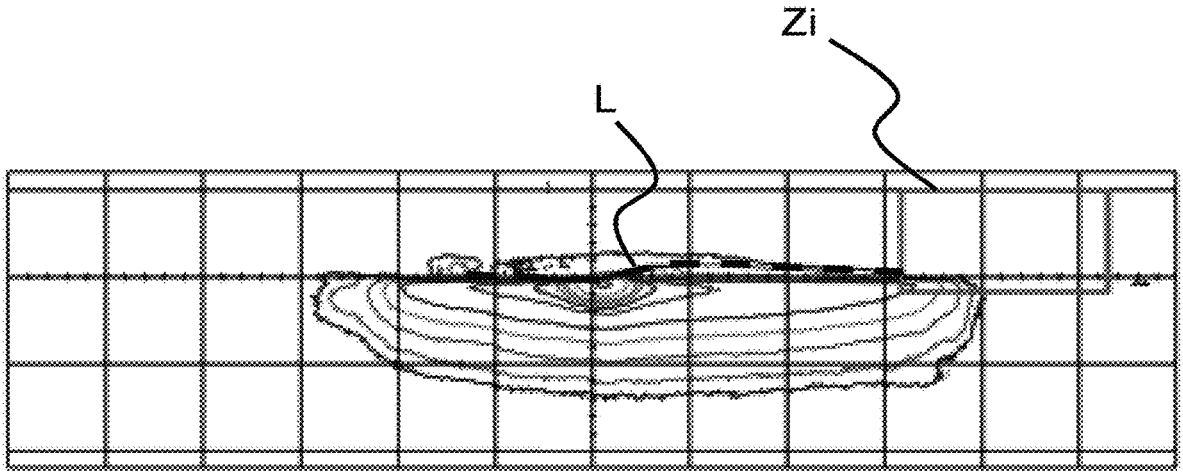

Moreover, this beam contains an upper cutoff line L, as illustrated in FIG. 6. This cutoff line L corresponds to the image of the ridge 4*a*, which therefore forms the cutoff-generating edge of the deflector 4, the rays being sent at the very highest to the cutoff line (rays r1) or below (rays r2 and r3).

Here, this beam is a central segment of a low beam. Specifically, it may be seen that the ridge 4*a* comprises an oblique segment and two horizontal segments on either side of this oblique segment, corresponding to the shape of the cutoff line L. The latter is illustrated by the dashed line in FIG. 6, the isolux curve thereabove represents a very low intensity that does not generate glare. Most of the rays are sent below this cutoff line L.

Figure 3:
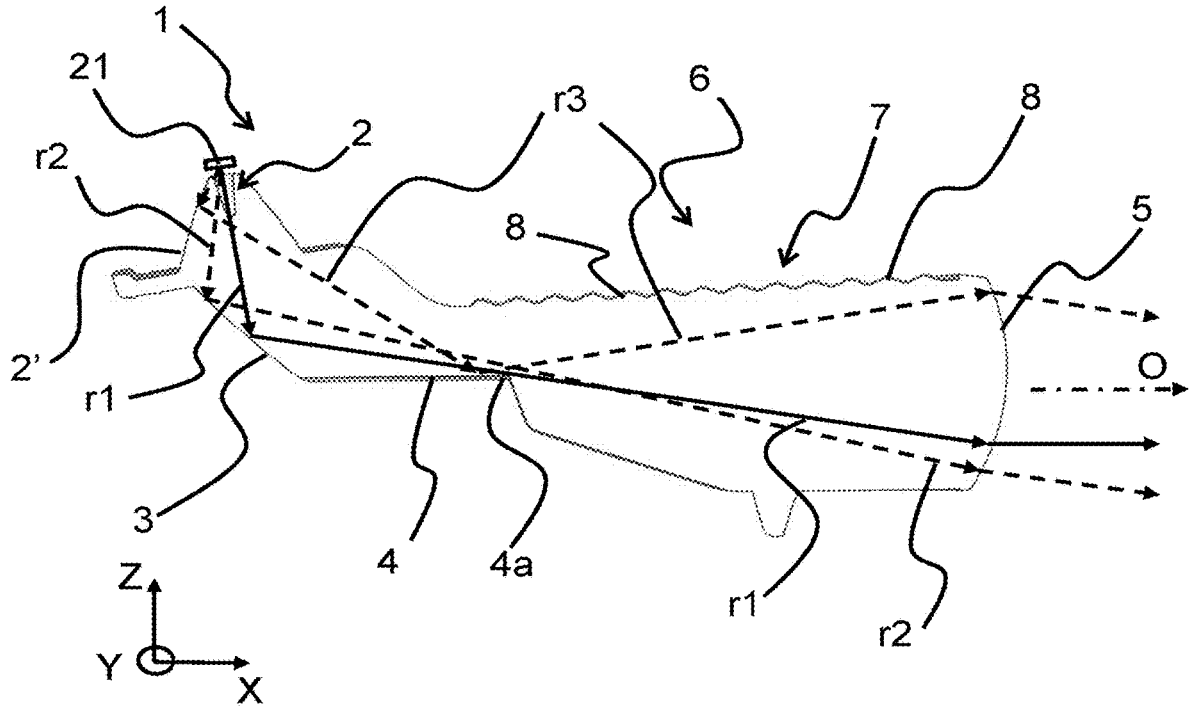
FIG. 3 is a longitudinal cross section of the optical part of FIG. 1, in which a light source is also shown.

The second plurality of collimators here comprises five collimators 2" that are each optically coupled from upstream to downstream to a reflecting unit 3", a cutoff-generating unit 4" and an exit unit 5", which are arranged so as to form the light rays emitted by the light source so as to form a beam containing a horizontal cutoff, according to the same principle as that illustrated in FIG. 3. The difference is that here the cut-off ridge 4*a*" is in a horizontal plane.

The central segment and the beam containing the horizontal cutoff are emitted at the same time so as to form a low beam.

The dioptric interfaces forming the entrance dioptric interface 2 of the collimators 2', 2", the reflecting units 3, 3", the deflectors 4, 4" forming the cutoff-generating units, and the exit dioptric interfaces 5, 5", therefore allow, via their arrangement, the beam to be formed so that it corresponds to a low beam. These dioptric interfaces therefore form the active surfaces of the optical part 1.

It may therefore in addition be seen that all the surfaces are not designed to receive the light rays originally emitted by the LEDs 21. They do not participate in the formation of the light beam. These surfaces are thus called inactive surfaces.

It is essentially a question of surfaces joining the active surfaces.

Figure 2:
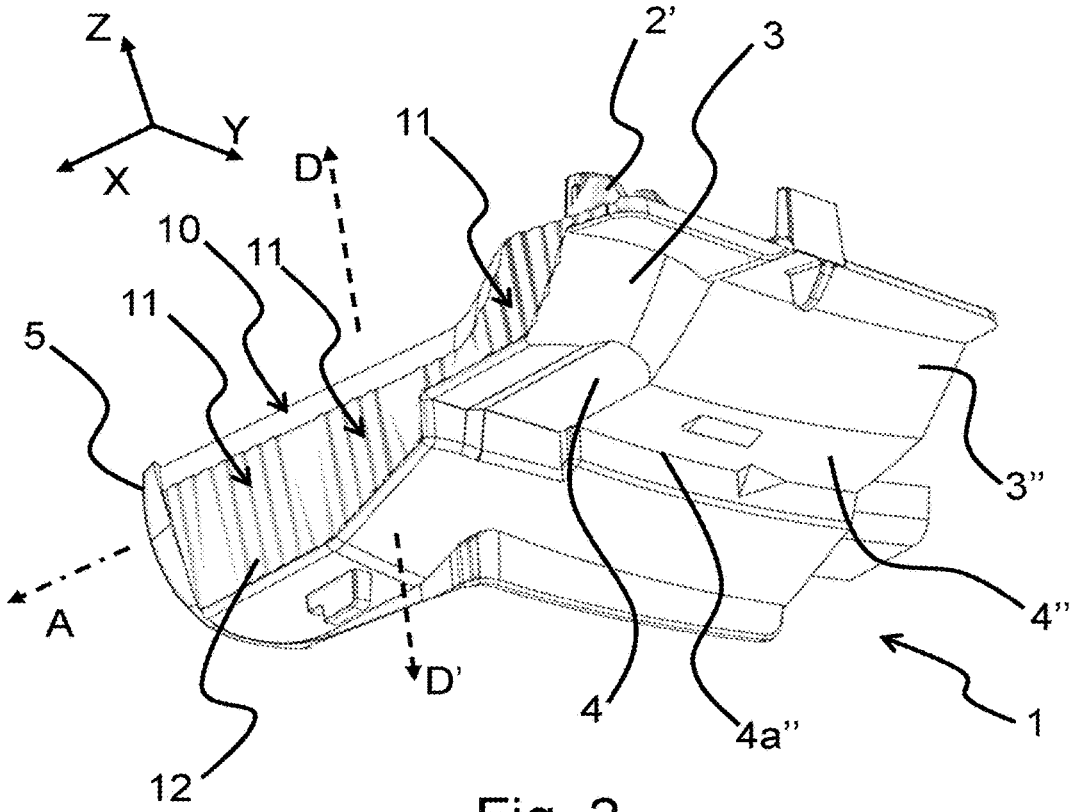
FIG. 2 is a perspective view from the rear and below of the optical part of FIG. 1.

Among these inactive surfaces, a front upper surface 6 and a left lateral surface 10 may be seen in FIGS. 1 to 3. As may be seen, these inactive surfaces 6, 10 comprise corrugations, and they are referred to below as the upper corrugated surface 6 and the lateral corrugated surface 10.

These corrugations allow a maximum, or even all of the parasitic light beams to be removed from the beam.

Figure 5:
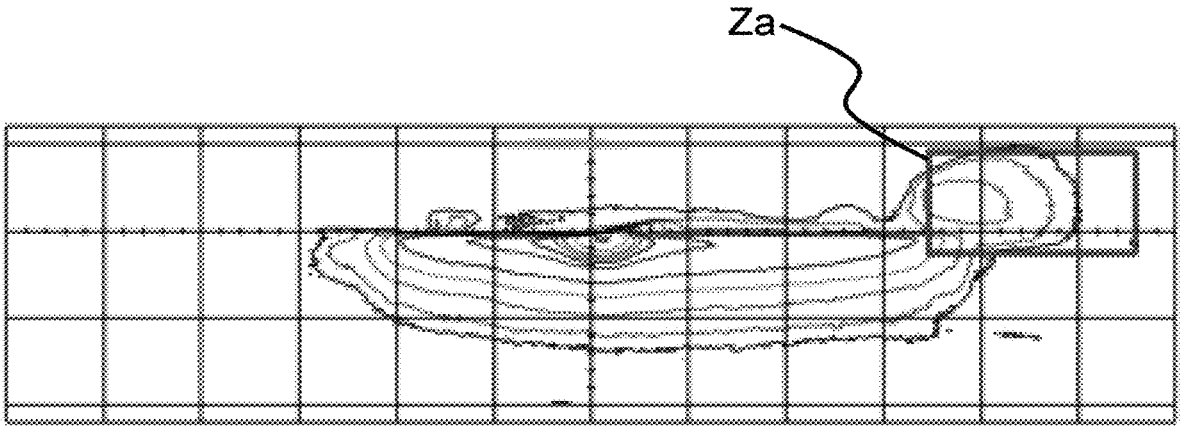
FIGS. 5 and 6 illustrate the isolux curves of light beams projected onto a vertical screen, in particular at 25 metres, these beams being obtained with an optical part such as that in FIG. 1 but without the periodic surface variation and with the optical part of FIG. 1, respectively.

FIG. 5 shows the beam obtained with an optical part (not shown) identical to that of FIGS. 1 to 3 except that the inactive surfaces are devoid of corrugations.

A luminous protuberance above the cut-off line may be observed in the zone Za. The obtained beam is therefore not as expected. This region of extra brightness is due to parasitic rays having reached the left lateral and front upper surfaces. Since these surfaces were not designed for this, these rays may, as here, be steered in the beam to undesirable locations.

In certain cases, these rays may even cause the drivers of followed or oncoming vehicles to be subjected to glare.

To remedy this, the invention proposes, as in this example, that at least one of the inactive surfaces comprises a scattering segment so as to scatter the rays that reach it.

In this example, illustrated in FIGS. 1 to 3, the front upper surface 6 comprises such a scattering segment, which is called the upper scattering segment 7. Likewise, the left lateral surface 10 comprises three scattering segments, called lateral scattering segments 11.

These scattering segments 7, 11 are covered with a plurality of scattering structures 8, 12 that are arranged so as to scatter the rays that reach the corresponding scattering segment. Thus, these rays will either be emitted outside of the field of projection, namely off the screen illustrated in FIG. 6, or be spread, so that they will not form a discomforting region of extra brightness in this beam.

These structures 8, 12 are here arranged in such a way that the scattering segments 7, 11 are corrugated.

In the lateral scattering segments 11, these corrugations are ordered in a single given and here longitudinal direction. Thus, these corrugations form striations 12 that are parallel to one another in a direction orthogonal to this longitudinal direction. As here, these striations are parallel to a demoulding direction D/D' of the optical part 1.

In the upper scattering segments 7, these corrugations are ordered in two given directions that are transverse to each other, here in the transverse direction Y and in the longitudinal direction X. The corrugations thus form pillows 12 allowing demoulding in the demoulding direction D/D' of the optical part 1.

Thus, the corrugations of the scattering segments 7, 11 allow the optical part 1 to be produced by moulding with two plates, without a plate or complex movements needing to be added to produce the scattering structures.

In this example embodiment, particularly advantageous results have been obtained by producing the pluralities of scattering structures 8, 12 and the corresponding corrugations via a periodic variation in the corresponding active surface 6, 10.

Figure 4:
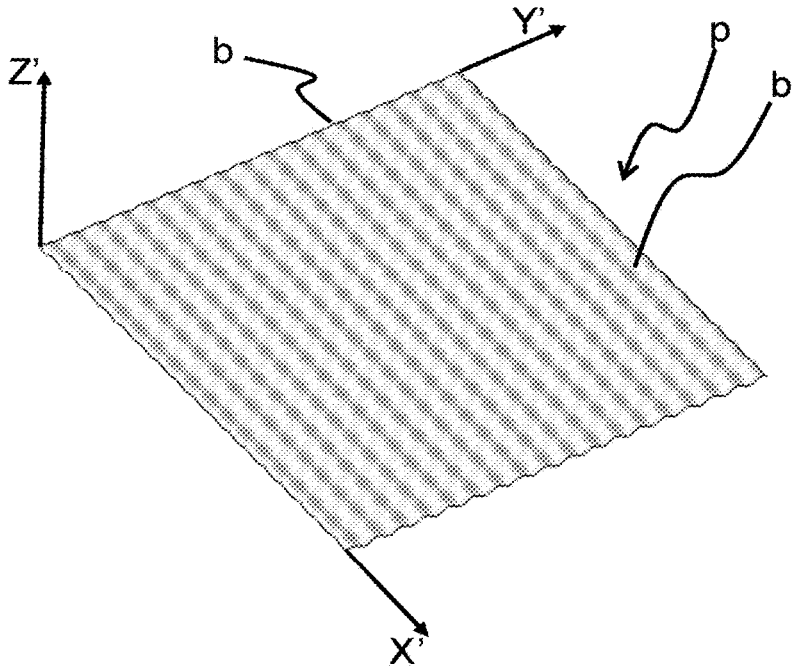
FIG. 4 is a perspective view of an example of surface variations such as those of the optical part of FIG. 1.

FIG. 4 illustrates an example of a regular periodic variation applicable to a scattering surface p ordered solely in two directions X', Y' of variation that are transverse to each other, said directions in particular being intended to be orthogonal to the demoulding direction (which here is the vertical direction Z') of the optical part. In other words, in FIG. 4, the surface varies in the vertical direction Z' both in the longitudinal direction L and in the transverse direction Y'.

Here, these variations also form pillows b.

In this example, the periodic variations are defined by at least one sinusoidal function.

The coefficients of the sinusoidal components may nevertheless be varied in the directions in which the corrugations are ordered, which are called the propagation directions X' and Y' below.

Generally, according to the invention, as in this example, this surface may be defined by the following equation:

$$Z'=X'_\text{Thickness}*\sin(X'_\text{Period}*\pi*x)+Y'_\text{Thickness}*\sin(Y'_\text{Period}*\Pi*y)$$

with:

X'_Thickness: thickness along X' of the variation, namely the maximum peak to peak height, X'_Period: period of the variation in X', Y'_Thickness: thickness along Y' of the variation, namely the maximum peak to peak height, Y'_Period: period of the variation in Y', x: longitudinal value along the longitudinal axis X' y: longitudinal value along the transverse axis Y'.

X', Y' and Z' will be oriented depending on the orientation of the corrugated surface.

For example, regarding the lateral scattering segments 11, the sinusoidal variation is ordered solely along the longitudinal axis X, with a variation about this axis X in the XZ plane. There is no variation in a vertical or transverse propagation direction.

The values of the coefficients may therefore be:

X'_Thickness=0.3 mm

X'_Period=21

Y'_Thickness=0 mm

Y'_Period=0

It will be noted that, with respect to the example of FIG. 4, Y corresponds to Z', X to X' and Z to Y' (in FIG. 4 the surface is horizontal, whereas it is vertical in the optical part 1 such as may be seen in FIG. 2).

Regarding the upper scattering segment 7, the sinusoidal variation is ordered solely along two axes: the longitudinal axis, with a variation about this axis X in the vertical XZ plane, and the transverse axis Y, with a variation about this axis Y in the vertical YZ plane.

Since this orientation is the same as in FIG. 4, Y approximately corresponds to Y', X approximately to X' and Z approximately to Z'.

The values of the coefficients may therefore be:

X'_Thickness=0.3 mm

X'_Period=21

Y'_Thickness=0.3 mm

Y'_Period=21

Figure 7:
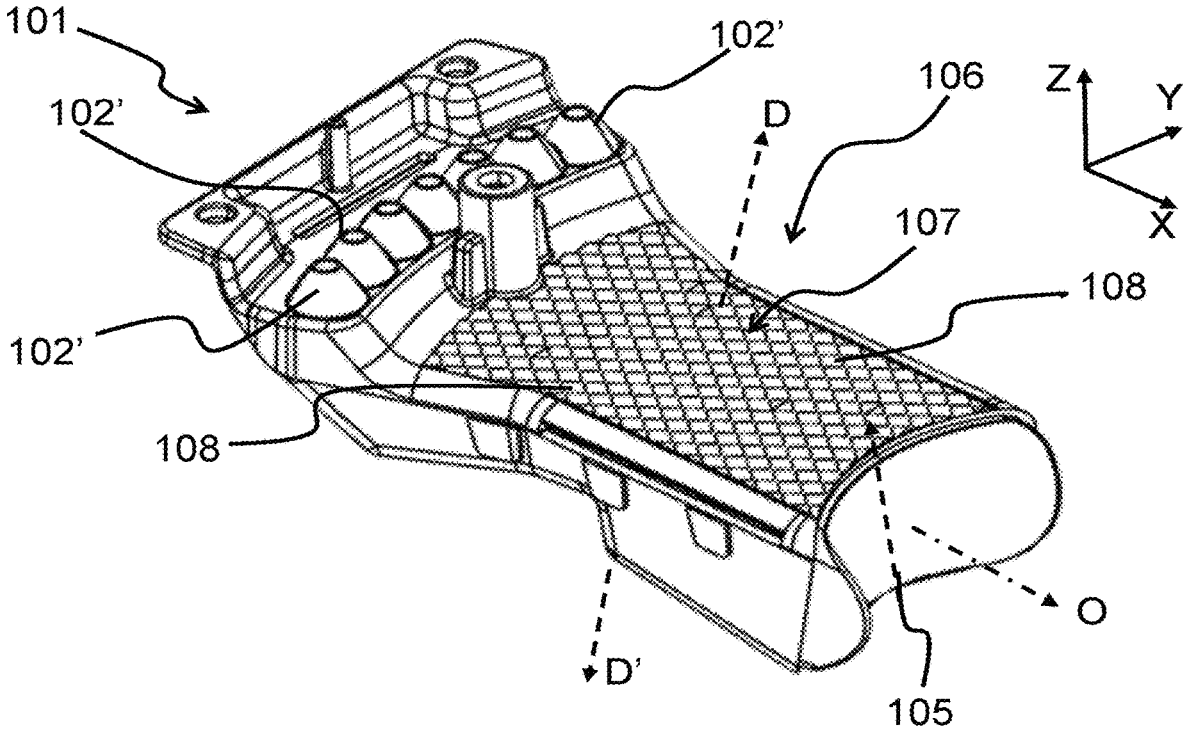
FIG. 7 is a perspective view from in front and above of an optical part according to a second example of the invention.
Figure 8:
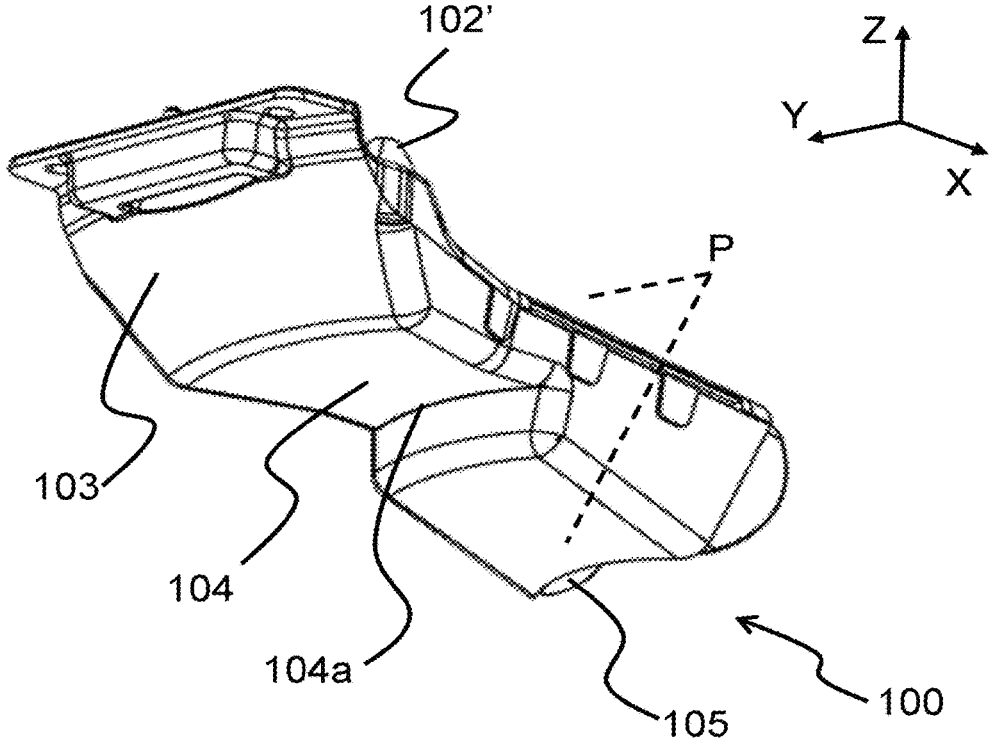
FIG. 8 is a perspective view from the rear and below of the optical part of FIG. 7.
Figure 9:
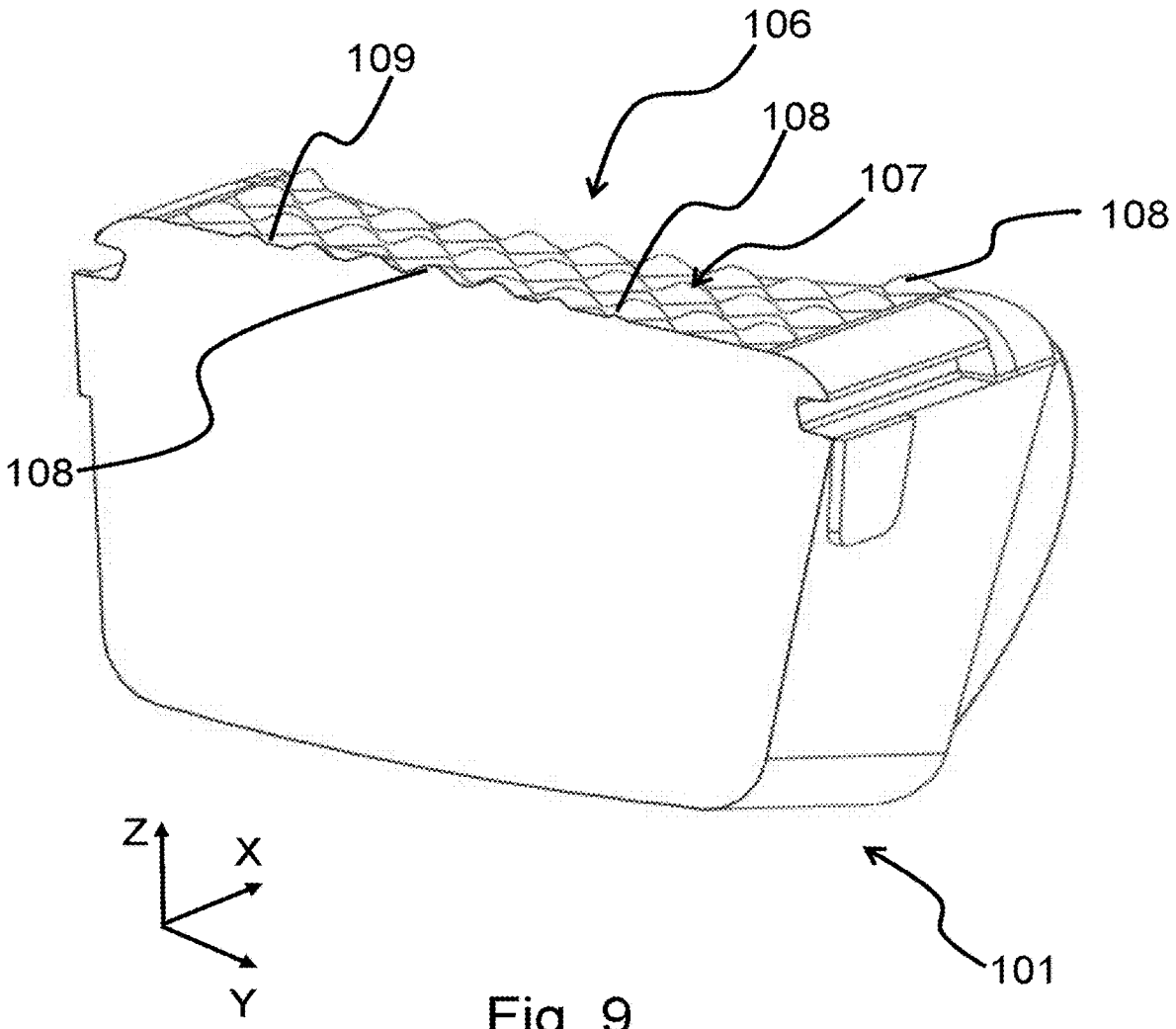
FIG. 9 is a transverse cross section of the optical part of FIGS. 7 and 8, in the plane P shown in FIG. 8.

FIGS. 7 to 9 illustrate an optical part 101 according to a second example embodiment of the invention.

The optical part 101 according to this second example is similar to the first. Only key differences will be discussed below. As regards the other features, reference may be made to the above description (it will be noted that between the first example and the second example, means performing the same functions have been referenced with references increased by 100).

The optical part 101 comprises a single first plurality of collimators 102', which are each intended to receive the light rays emitted by a light source, just like the second plurality of collimators 2" of the first example.

The optical part 101 also comprises, in addition to the dioptric interfaces of the collimators 2", dioptric interfaces forming active surfaces, namely respectively: a reflecting unit 103, a deflector 104, and a projecting unit 105 or exit dioptric interface 105.

These active surfaces 103, 104, 105 are coupled in the same way as in the first example so as to form a cutoff-containing beam. Thus, the reader may refer to FIG. 3 and to the corresponding description for an illustration of the paths of rays and of the formation of a cut-off line in the beam with the deflector 104.

Here, this beam is a beam with a horizontal cutoff line. Specifically, it may be seen that the ridge 104*a*, the image of which forms the cut-off line, is contained in a horizontal XY plane.

The optical part 101 is intended to be mounted in a headlamp (not shown) with an optical part (not shown) that is similar but the ridge of which has the shape of the oblique cut-off at the centre of a low beam, for example having an oblique segment and two horizontal segments on either side of this oblique segment.

An additional module with an identical optical part, or at least one that also generates a horizontal cut-off, will also possibly be used in the device, so as to superpose its beam on that coming from the illustrated optical part 101.

In this second example, only one inactive surface 106 comprises a scattering segment 107 arranged so as to scatter the rays that reach it. It is here a question of a front upper surface.

According to the same principle as in the first example, these rays will be either be emitted outside of the field of projection, or spread, so that they will not form a discomforting region of extra brightness in this beam.

As may be seen in FIGS. 7 and 9, this inactive surface 106 comprises corrugations, forming scattering pillows 108.

These corrugations are here periodic variations.

Here, it is also the example surface variation of FIG. 4 that has been applied to the scattering surface 106. The periodic variations are therefore defined by at least one sinusoidal function.

Here, the construction is therefore again defined by the preceding equation, but with sinusoidal components of different coefficients and also with the addition of conditions.

The definition of the inactive surface 106 may therefore be defined thus:

$$\text{If: } X'_\text{Thickness}*\sin(X'_\text{Period}*\pi*x)+Y'_\text{Thickness}*\sin(Y'_\text{Period}*\pi*y)<0 \quad 1.$$

$$\text{Then: } Z'=0$$

$$\text{If: } X'_\text{Thickness}*\sin(X'_\text{Period}*\pi*x)+Y'_\text{Thickness}*\sin(Y'_\text{Period}*\pi*y)\geq 0 \quad 2.$$

$$\text{Then: } Z'=X'_\text{Thickness}*\sin(X'_\text{Period}*\pi*x)+Y'_\text{Thickness}*\sin(Y'_\text{Period}*\pi*y)$$

The values of the coefficients may therefore be:

X'_Thickness=0.3 mm

X'_Period=35

Y'_Thickness=0.3 mm

Y'_Period=35

X', Y' and Z' are oriented depending on the orientation of the corrugated surface. Thus, with respect to the example of FIG. 4, Y corresponds to Z', X to X' and Z to Y'.

As may be seen in FIG. 9, because of these conditions, clipping of the variations is observed, leaving certain small segments of planar surface 109 between certain pillows 108.

Thus, generally, according to the invention, on the basis of a given sinusoidal equation, in particular the aforementioned one, it is possible to adjust the variations in an inactive surface generating parasitic rays so as to minimize the number of these parasitic rays in the beam exiting from the optical part.

The invention claimed is:

1. A single-piece optical part made of transparent or translucent material, comprising:

a plurality of active surfaces arranged to form a beam, including an entrance dioptric interface and an exit dioptric interface, and inactive surfaces joining the active surfaces, at least one of the inactive surfaces comprising a scattering segment so as to scatter rays that reach the scattering segment, wherein the active surfaces comprise collimators that are each optically coupled to a reflecting unit, each reflecting unit being optically coupled to a unit for generating a cutoff, the unit for generating a cutoff being coupled to an exit unit, wherein the scattering segment is covered with a plurality of periodic varying structures arranged so as to scatter the rays reaching the scattering segment, and wherein the inactive surfaces do not participate in formation of the beam.

2. The optical part according to claim 1, wherein the scattering segment is covered with a plurality of pillow structures arranged so as to scatter the rays reaching the corresponding scattering segment.

3. The optical part according to claim 2, wherein the plurality of pillow structures is formed by a periodic variation in the corresponding inactive surface.

4. The optical part according to claim 3, wherein the periodic variation in the scattering segment of the inactive surface or in at least one of the inactive surfaces is arranged solely in two variation directions that are transverse to each other.

5. The optical part according to claim 4, wherein the optical part is obtained by moulding, the two variation directions being orthogonal to a demoulding direction.

6. The optical part according to claim 5, wherein the periodic variations are defined by at least one sinusoidal function.

7. The optical part according to claim 4, wherein the periodic variations are defined by at least one sinusoidal function.

8. The optical part according to claim 2, wherein the scattering segment is corrugated.

9. The optical part according to claim 2, wherein the scattering segment comprises striations that are parallel to one another.

10. The optical part according to claim 2, wherein one of the active surfaces is a deflector arranged so as to receive light rays coming from the entrance dioptric interface and to steer them downstream.

11. A luminous vehicle device comprising an optical part according to claim 2 and at least one light source that emits its rays essentially towards the entrance dioptric interface.

12. The optical part according to claim 1, wherein the scattering segment is corrugated.

13. Optical part according to claim 12, wherein the scattering segment comprises striations that are parallel to one another.

14. The optical part according to claim 1, wherein the scattering segment comprises striations that are parallel to one another.

15. The optical part according to claim 14, wherein the optical part is obtained by moulding, the striations being parallel to a demoulding direction.

16. The optical part according to claim 1, wherein the scattering segment is covered with a plurality of structures having periodic variations defined by at least one sinusoidal function.

17. The optical part according to claim 1, wherein one of the active surfaces is a deflector arranged so as to receive light rays coming from the entrance dioptric interface and to steer them downstream.

18. A luminous vehicle device comprising an optical part according to claim 1 and at least one light source that emits its rays essentially towards the entrance dioptric interface.

19. A single-piece optical part made of transparent or translucent material, comprising:

a plurality of active surfaces arranged to form a beam, including an entrance dioptric interface and an exit dioptric interface, and inactive surfaces joining the active surfaces, wherein at least one of the inactive surfaces comprises a scattering segment so as to scatter rays that reach the scattering segment, and the at least one scattering segment has sinusoidal surface variations along an optical axis direction and in a direction transverse to the optical axis direction, wherein the sinusoidal surface variations are defined as:

$$Z=\text{Thickness1}*\sin(\text{Period1}*\pi*x)+\text{Thickness2}*\sin(\text{Period2}*\pi*y)$$

with:

Thickness1 being a maximum peak to peak height in a first direction being a direction in which the surface variations are ordered, Period2 being a period of variation in the first direction, Thickness2 being a maximum peak to peak height in a second direction orthogonal to the first direction, Period2 being period of variation in the second direction, Z is a height in a vertical direction, x being a longitudinal value along the first direction, and y being a longitudinal value along the second direction.

20. The optical part according to claim 1, wherein the inactive surfaces comprise a first scattering segment having a periodic variation in one direction and a second scattering segment having periodic variations in two directions orthogonal to each other.

21. The optical part according to claim 20, wherein the first scattering segment is positioned in a lateral portion of the optical part and the second scattering segment is positioned in an upper portion of the optical part.

22. The optical part according to claim 19, wherein the inactive surfaces do not participate in formation of the beam.

23. The optical part according to claim 19, wherein the scattering segment is covered with a plurality of pillow structures arranged so as to scatter the rays reaching the scattering segment.

* * * * *